US006511209B1

(12) United States Patent
Chiang

(10) Patent No.: US 6,511,209 B1
(45) Date of Patent: Jan. 28, 2003

(54) LIGHTING FIXTURE

(76) Inventor: Albert C. L. Chiang, 5000 No. Pkwy. Calabasas, #304, Calabasas, CA (US) 91302

( * ) Notice: Subject to any disclaimer, the term of this patent is extended or adjusted under 35 U.S.C. 154(b) by 0 days.

(21) Appl. No.: 09/968,573

(22) Filed: Oct. 2, 2001

(51) Int. Cl.[7] ..... F21V 29/00

(52) U.S. Cl. ..... 362/294; 362/290; 362/342; 362/226; 362/345; 362/373; 362/264

(58) Field of Search ..... 362/294, 290, 362/342, 226, 345, 373, 264

(56) References Cited

U.S. PATENT DOCUMENTS

| | | | | |
|---|---|---|---|---|
| 1,007,070 A | * | 10/1911 | Cowper-Coles | 362/293 |
| 1,500,639 A | * | 7/1924 | Rekar | 362/294 |
| 1,637,786 A | * | 8/1927 | Rekar | 362/294 |
| 1,963,949 A | * | 6/1934 | Adams et al. | 362/294 |
| 2,069,950 A | * | 2/1937 | Greppin | 362/285 |
| 2,690,106 A | * | 9/1954 | Trump | 355/104 |
| 2,799,773 A | * | 7/1957 | Schwartz | 362/342 |
| 3,127,111 A | * | 3/1964 | Baring | 362/6 |
| 3,299,884 A | * | 1/1967 | Moore et al. | 600/249 |
| 3,588,488 A | * | 6/1971 | Lauterbach | 362/2 |
| 4,290,097 A | | 9/1981 | Block et al. | |
| 4,497,016 A | | 1/1985 | Sachse | |
| 4,503,360 A | | 3/1985 | Bedel | |
| 4,630,182 A | | 12/1986 | Moroi | |
| 4,658,338 A | | 4/1987 | Bertozzi | |
| 4,780,799 A | | 10/1988 | Groh | |
| 5,072,349 A | | 12/1991 | Maniga | |
| 5,091,835 A | | 2/1992 | Malek et al. | |
| 5,134,554 A | | 7/1992 | Donato et al. | |
| 5,136,489 A | | 8/1992 | Cheng et al. | |
| 5,138,541 A | | 8/1992 | Kano | |
| 5,390,096 A | | 2/1995 | DeKleine et al. | |
| 5,504,666 A | | 4/1996 | Carmichael | |
| 5,544,029 A | | 8/1996 | Cunningham | |
| 5,651,609 A | | 7/1997 | Pelton et al. | |
| 5,758,955 A | | 6/1998 | Belliveau | |
| 5,839,822 A | | 11/1998 | Oechsle | |
| 5,947,592 A | | 9/1999 | Barlow | |
| 6,030,095 A | | 2/2000 | Moore et al. | |
| 6,116,758 A | | 9/2000 | Lin | |
| 6,132,069 A | | 10/2000 | Sato et al. | |
| 6,183,114 B1 | | 2/2001 | Cook et al. | |

OTHER PUBLICATIONS

WO 90/03537, Hatjasalo, Light Fitting Arrangement, Apr. 5, 1990.*

* cited by examiner

*Primary Examiner*—Sandra O'Shea
*Assistant Examiner*—Sharon Payne
(74) *Attorney, Agent, or Firm*—Jack C. Munro

(57) ABSTRACT

A lighting fixture for a heat generating light bulb which includes a pair of heat sinks to assist in dissipating heat and also an airflow path that extends through the lighting fixture that causes air to flow past the light bulb and the heat sinks with the heated air to pass through louvers and openings formed within the housing shell of the light fixture into the ambient.

14 Claims, 2 Drawing Sheets

LIGHTING FIXTURE

BACKGROUND OF THE INVENTION

1. Field of the Invention

The field of this invention relates to lighting fixtures and more particularly to a lighting fixture which is designed to dissipate heat in order to substantially prolong the life of the light bulb and also permit the lighting fixture to use higher wattage light bulbs.

2. Description of the Related Art

The use of lighting fixtures for light bulbs has long been known. The single most destructive thing in conjunction with lighting fixtures is the heat that is generated by the light bulb. This heat that is generated not only causes the lighting fixture to be raised to an excessively high temperature but will also cause the light bulb to prematurely fail. As a result, many light fixtures are designed to be used with lower wattage light bulbs. Lower wattage light bulbs do not give off a substantial amount of light. In certain installations, a greater amount of light is required. There is a need to construct a lighting fixture which readily dissipates heat that is generated from the light bulb which will keep the overall body of the lighting fixture at a decreased temperature and will also permit usage of a higher wattage bulb with the heat that is generated by the bulb being dissipated into the ambient substantially extending the life of the light bulb.

SUMMARY OF THE INVENTION

A first basic embodiment of lighting fixture which utilizes a light bulb mounted in conjunction with a socket. Surrounding the socket is a first heat sink with there being a second heat sink surrounding the first heat sink. A ring-shaped shell surrounds the second heat sink with this ring-shaped shell having a plurality of openings. A forward housing shell is mounted on the ring-shaped shell. The forward housing shell surrounds the light bulb in a spaced relationship forming an annular chamber. A rear housing shell is mounted adjacent the ring-shaped shell and located opposite the forward housing shell. The rear housing shell has a base which is adapted to be electrically connected to the light socket. The rear housing shell has a series of louvers. Heat that is generated by the light bulb is dissipated by air flowing through the forward housing shell, past the first heat sink and the second heat sink and into the ambient through the openings and the louvers.

A further embodiment of this invention is where the first basic embodiment is modified by having the first heat sink mounted on the socket.

A further embodiment of this invention is where the first heat sink is defined as comprising a metallic sleeve with a plurality of outwardly extending radial fins.

A further embodiment of this invention is where the first basic embodiment is modified to include a mounting ring on which is mounted electronic components and is located within the annular chamber of the forward housing shell.

A further embodiment of this invention is where there is insulation located within this annular chamber.

A further embodiment of this invention is where there is an outer cover mounted in conjunction with the forward housing shell.

A further embodiment of this invention is where the outer cover includes aligning tabs with these aligning tabs to engage with the light bulb to properly align and support the light bulb within the light socket within the lighting fixture.

A second basic embodiment of this invention is where there is a light bulb mounted in conjunction with a socket. Surrounding the socket is a heat sink assembly. A ring-shaped shell surrounds this heat sink assembly with this ring-shaped shell including a plurality of openings. A forward housing shell is mounted on the ring-shaped shell with the forward housing shell surrounding the light bulb in a spaced relationship forming an annular chamber. A rear housing shell is mounted adjacent to the ring-shaped shell and located opposite the forward housing shell. The rear housing shell has a base which is adapted to electrically connect with a light socket. The rear housing shell has a series of louvers. Heat that is generated by the light bulb is dissipated by air flowing through the forward housing shell, past the heat sink assembly and into the ambient through the openings and the louvers.

A further embodiment of this invention is where the second basic embodiment is modified by the heat sink assembly being mounted on the socket.

A further embodiment of this invention is where there is a mounting ring mounted within the annular chamber of the forward housing shell with this mounting ring having mounted thereon electronic components.

A further embodiment of this invention is where the la annular chamber includes insulation to protect the electronic components of the mounting ring from over heating.

A further embodiment of this invention is where there is mounted an outer cover in conjunction with the forward housing shell with this outer cover surrounding the light bulb.

A further embodiment of this invention is where the outer cover includes aligning tabs which engage with the light bulb to support the light bulb and keep it properly aligned within the lighting fixture.

A further embodiment of this invention is where the second basic embodiment if modified by the heat sink assembly including in part a metallic sleeve with a plurality of outwardly extending radial fins.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
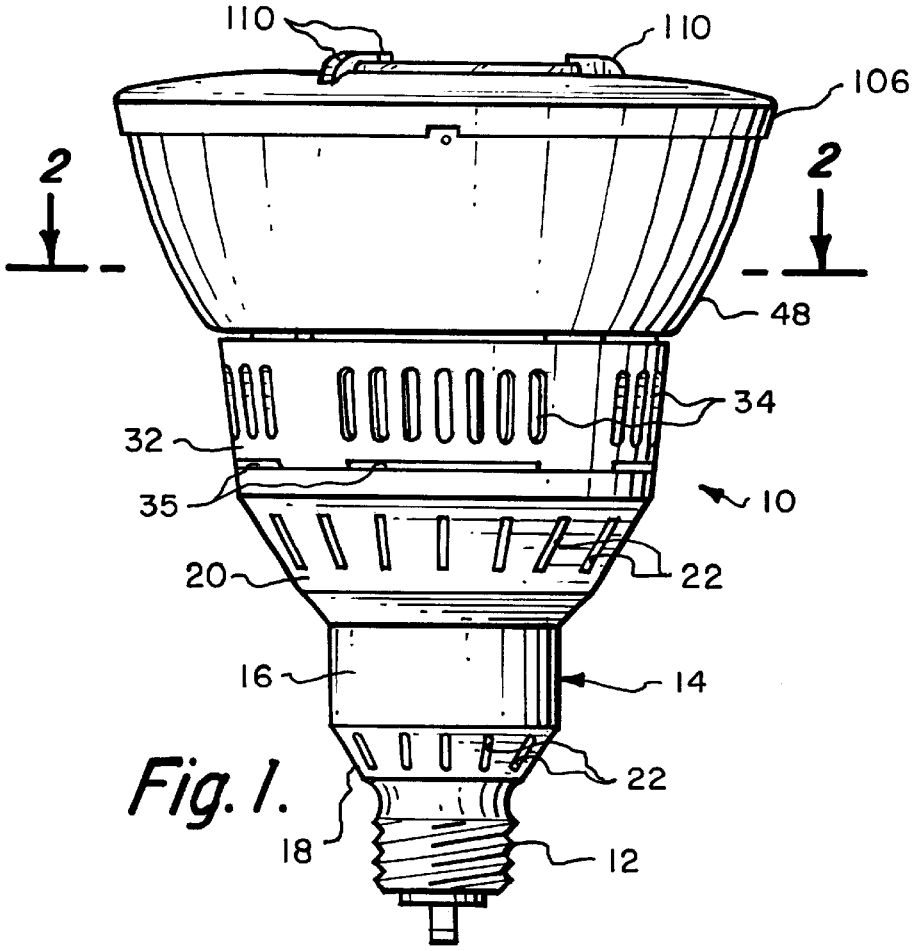
FIG. 1 is an external side view of the lighting fixture of the present invention.
Figure 2:
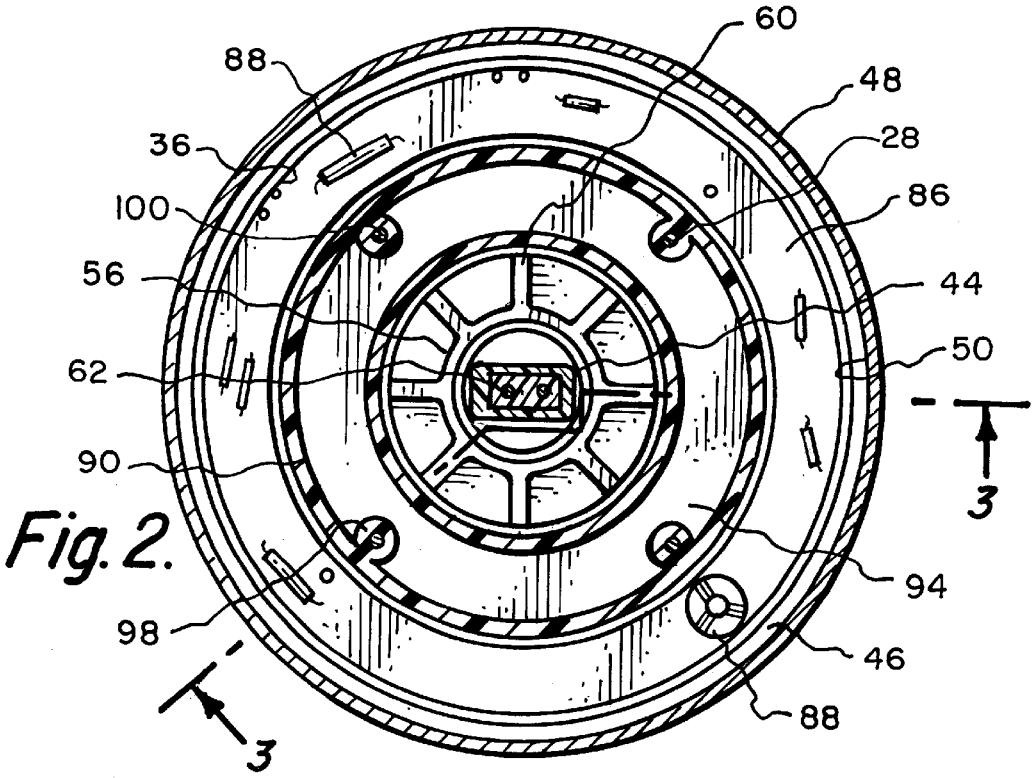
FIG. 2 is a transverse cross-sectional view of the lighting fixture of the present invention taken along line 2—2 of FIG. 1.

Referring particularly to the drawings, there is shown the lighting fixture 10 of this invention. Lighting fixture 10 has a screw base 12 which is designed to be screw threadingly received within a conventional lighting socket, which is not shown. The screw base 12 is fixedly mounted on a rear housing shell 14. The rear housing shell 14 is primarily hollow, it has an exterior configuration which comprises a cylindrical shaped section 16 located between truncated cone-shaped sections 18 and 20. The truncated cone-shaped sections 18 and 20 both include a series of louvers 22. The louvers 22 are basically elongated slots.

Integrally formed with the rear housing shell 14 and located within the internal chamber of the rear housing shell 14 are four in number of spaced apart mounting posts 26. Each mounting post 26 is designed to receive a screw fastener 28. Mounted within the upper open end of the rear housing shell 14 is a baseplate 30. Baseplate 30 is basically flat. The baseplate 30 is located between the screw fasteners 28. Mounted against the baseplate 30 and externally of the mounting posts 26 is a ring-shaped shell 32. Formed within the ring-shaped shell 32 are a series of elongated openings 34 and a series of elongated slots 35. There are four in number of the slots 35. The ring-shaped shell 32 has an internal chamber 36. Integrally connected with the ring-shaped shell 32 and located within the internal chamber 36 are four in number of short posts 38. A short post 38 is to align with a mounting post 26. Each short post 38 has a center hole 40. Each screw fastener 28 is to be located through a center hole 40 prior to connection with a mounting post 26.

A light bulb 42 is plugged into a socket 44. The light bulb 42 is centrally located within an internal chamber 46 of a forward housing shell 48. The forward housing shell 48 has an enlarged access opening 50. The forward housing shell 48 will normally be constructed of a thin sheet material, such as aluminum.

The socket 44 has electrical wires 52 and 54 connecting thereto. The electrical wires 52 and 54 pass through a first heat sink 56. The socket 44 is fixedly secured to the first heat sink 56 by means of bolt fasteners 58. The first heat sink 56 takes the form of a sleeve from which there is outwardly extending in a radial manner a plurality of fins 60. Each electrical wire 52 and 54 connect to a separate socket hole 62 with there being two in number of such socket holes 62 formed within the socket 44. The light bulb 42 is to have a pair of prongs, which is not shown, each of which is to engage with a socket hole 62. Thereby one prong electrically connects with electrical wire 52 and the other prong engages with electrical wire 54.

The wires 52 and 54 pass through respective through openings 64 and 66 formed within the first heat sink 56. The first heat sink 56 is fixedly mounted by appropriate screw fasteners, which are not shown, onto a second heat sink 68. Second heat sink 68 includes a baseplate 70 on which the first heat sink 56 is mounted. Extending outwardly from baseplate 70 are a plurality of L-shaped posts 72. The posts 72 are unattached at their outer end. Between each pair of L-shaped posts 72 is located a connecting post 74. The connecting posts 74 are integrally connected to an annular ring 76. The annular ring 76 includes four in number of cut-outs, which are not shown. Within each cut-out is to be located a short post 38. In this way, the second heat sink 68 is locked to the rear housing shell 14.

The first heat sink 56 will normally be constructed of aluminum material as aluminum is readily conductive of heat. The second heat sink 68 is to be constructed of any material that facilitates conducting of heat which again would probably be of aluminum. The heat sinks 56 and 68 can be constructed of any material that facilitates the conducting of heat.

Figure 3:
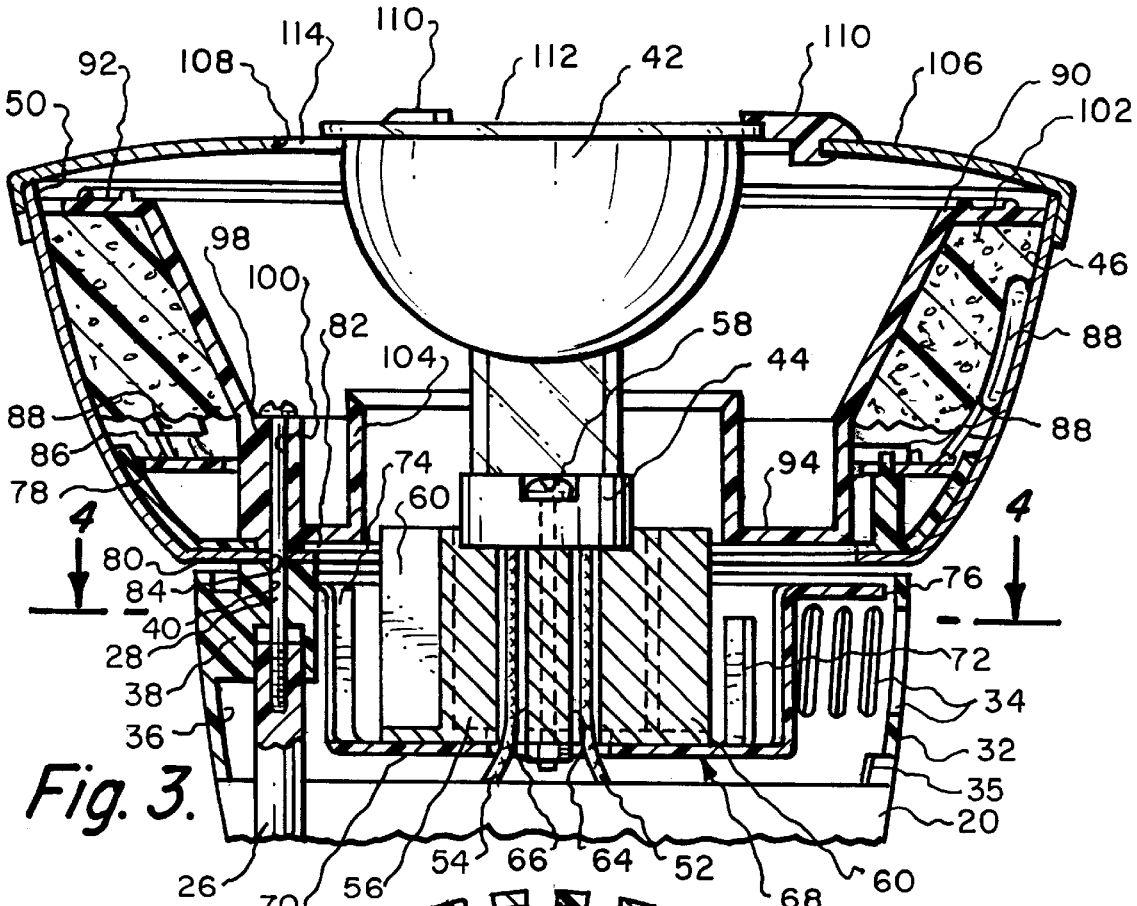
FIG. 3 is a longitudinal cross-sectional view through the lighting fixture of the present invention taken along line 3—3 of FIGS. 2.
Figure 4:
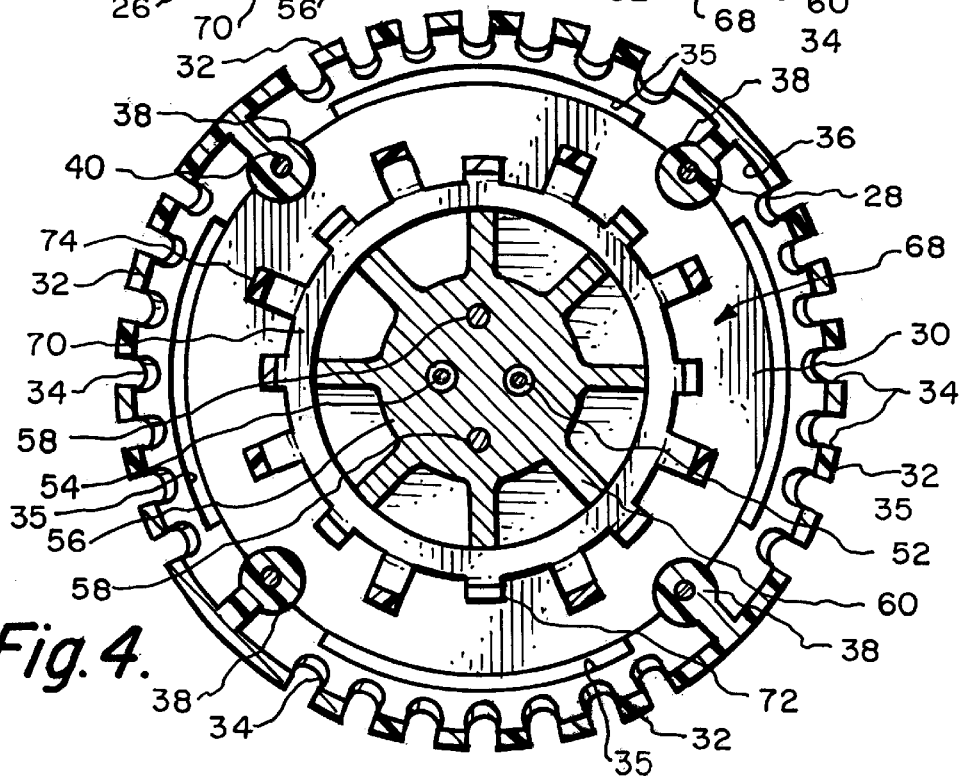
FIG. 4 is a transverse cross-sectional view through the lighting fixture of the present invention taken along line 4—4 of FIG. 3.

Mounted directly against the wall of the internal chamber 46 is a plastic or ceramic annular mount 78. This annular mount 78 is mounted directly against annular-shaped inwardly extending flange 80 which is formed integral with the forward housing shell 48. Extending in an inward direction from the inwardly extending flange 80 are four in number of extensions 82. Each extension 82 is to connect with a short post 38. Each extension 82 has a hole 84 formed therein. Each screw fastener 28 is to extend through a hole 84 of an extension 82. This fixedly mounts in position the forward housing shell 48 relative to the rear housing shell 14. Mounted against the annular mount 78 is a mounting ring 86. The mounting ring 86 will normally be constructed of a plastic material. Mounted on the mounting ring 86 is to be a plurality of electrical components 88. Some of the components 88 extend from the mounting ring 86 and are fixedly mounted on the wall of the interior chamber 46, as is clearly shown in FIG. 3 of the drawings.

Mounted within the internal chamber 46 is a ceramic or plastic collar 90. Collar 90 has an upper annular flange 92. The peripheral edge of the upper annular flange 92 abuts against the wall of the interior chamber 46. The collar 90 also includes a bottom wall 94. The bottom wall 94 has exteriorly mounted thereon a plurality of small protrusions which form feet, which are not shown. These feet are to rest against the annular ring 76. These feet will locate the bottom wall 94 slightly spaced from the annular ring 76. Collar 90 also includes four in number of posts 98. There is to be post 98 which is to align with a short post 38. Each post 98 includes a through hole 100 through which a screw fastener 28 is to be conducted. Therefore, by tightening of the screw fasteners 28, it can thusly be seen that the collar 90 is fixed to the rear housing shell 14.

The portion of the internal chamber 46 located between the exterior surface of the collar 90 and the internal wall 46 is to include a wad of fibrous material 102. The fibrous material 102 is to function as a heat insulator protecting the electronic components 88 that are mounted on the mounting ring 86.

Collar 90 also includes a center sleeve 104 that extends from the bottom wall 94. The center sleeve 104 surrounds and is spaced from the socket 44.

Mounted on the forward housing shell 48 is an outer cover 106. The outer cover 106 will normally be constructed of sheet metal and has a slight dome shape with the general overall configuration being that of a disc with the exception that there is a center hole 108 formed within the outer cover 106. The outer cover 106 is to be snapped onto the forward housing shell 48 and is removably secured thereto. Removal of the outer cover 106 is required in order to replace the light bulb 42. A typical light bulb would be a twelve volt, sixty-five watt Halogen bulb. Mounted to the outer cover 106 and extending within the center hole 108 are three in number of equally spaced apart tabs 110. Each tab 110 is fixed to the outer cover 106. The inner edge of the tab 110 is designed to engage with the annular peripheral lip 112 of the light bulb 42. Therefore, the tabs 110, in conjunction with outer cover 106, provide support for the light bulb 42 to keep the light bulb 42 in its established position and also to insure that the light bulb 42 is correctly aligned within the lighting fixture 10.

During use of the lighting fixture 10, heat that is generated from the light bulb 42 will be dissipated radially toward the collar 90. Let it be assumed that the lighting fixture is mounted in a vertically oriented position with the screw base 12 being located above the outer cover 106. Heat has a tendency to rise, so as the heat rises toward the second heat sink 68, air is to flow into the annular gap 114 which is formed by the center hole 108 relative to the annular peripheral lip 112 of the light bulb 42. This air flow will push the heat in contact with both heat sinks 56 and 68 and heat that is accumulated by these heat sinks 56 and 58 will be free to pass into the air through elongated openings 34, elongated slots 35 and louvers 22. During operation of the light bulb 42, there will be created a constant air flow through the openings 34, slots 34 and the louvers 22. This constant air flow does an effective job of dissipating created heat by the lighting fixture 10 thereby substantially prolonging the life of the light bulb 42 while also permitting use of a substantially increased wattage of light bulb 42 than was previously possible.

What is claimed is:

1. A lighting fixture comprising:

a light bulb;

a socket into which said light bulb is mounted;

a first heat sink surrounding said socket, said first heat sink being located directly adjacent said socket;

a second heat sink surrounding said first heat sink, said second heat sink being mounted on said first heat sink, some of the heat from said first heat sink to be conducted into said second heat sink;

a ring-shaped shell surrounding said second heat sink, said ring-shaped shell having a plurality of openings;

a forward housing shell mounted on said ring-shaped shell, said forward housing shell surrounding said light bulb in a spaced relationship forming an annular chamber; and a rear housing shell mounted adjacent said ring-shaped shell and located opposite said forward housing shell, said rear housing shell having a base which is adapted to electrically connect with a light socket, said rear housing shell having a series of louvers, whereby heat that is generated by said light bulb is dissipated in the ambient by air flowing through said forward housing shell past said first heat sink and said second heat sink into ambient through said openings and said louvers.

2. The lighting fixture as defined in claim 1 wherein:

said first heat sink is mounted on said socket.

3. The lighting fixture as defined in claim 1 wherein:

said first heat sink comprises a metallic sleeve which has a plurality of outwardly extending radial fins.

4. The lighting fixture as defined in claim 1 including:

a mounting ring mounted within said annular chamber, said mounting ring having electronic components mounted thereon.

5. The lighting fixture as defined in claim 4 including:

insulative material located within said annular chamber, said insulative material protecting said mounting ring and said electronic components from excessive heat that could damage said electronic components.

6. The lighting fixture as defined in claim 1 including:

an outer cover being mounted on said forward housing shell, said forward housing shell having an enlarged access opening, said outer cover substantially covering said access opening, said outer cover having a center opening, said light bulb being located within said center opening.

7. The lighting fixture as defined in claim 6 wherein:

said outer cover has a series of tabs, said tabs to engage with said light bulb, said tabs functioning to support and maintain proper alignment of said light bulb within said lighting fixture.

8. A lighting fixture comprising:

a light bulb;

a socket into which said light bulb is mounted;

a heat sink assembly surrounding said socket, said heat sink assembly locating in direct contact with said socket;

a ring-shaped shell surrounding said heat sink assembly, said ring-shaped shell having a plurality of openings;

a forward housing shell mounted on said ring-shaped shell, said forward housing shell surrounding said light bulb in a spaced relationship forming an annular chamber; and a rear housing shell adjacent to said ring-shaped shell and located opposite said forward housing shell, said rear housing shell having a base which is adapted to be electrically connected with a light socket, said rear housing shell having a series of louvers, whereby heat that is generated by said light bulb is dissipated to ambient by air flowing through said forward housing shell past said heat sink assembly and into ambient through said openings and said louvers.

9. The lighting fixture as defined in claim 8 wherein:

said heat sink assembly is mounted on said socket.

10. The lighting fixture as defined in claim 8 wherein:

a mounting ring is mounted within said annular chamber, said mounting ring having electronic components mounted thereon.

11. The lighting fixture as defined in claim 10 wherein:

insulative material is located within said annular chamber, said insulative material protecting said mounting ring and said electronic components from excessive heat that could damage said electronic components.

12. The lighting fixture as defined in claim 8 wherein:

an outer cover is being mounted on said forward housing shell, said forward housing shell having an enlarged access opening, said outer cover substantially covering said access opening, said outer cover having a center opening, said light bulb being located within said center opening.

13. The lighting fixture as defined in claim 12 wherein:

said outer cover has a series of tabs, said tabs to engage with said light bulb, said tabs functioning to support and maintain proper alignment of said light bulb within said lighting fixture.

14. The lighting fixture as defined in claim 8 wherein:

said heat sink assembly includes a heat sink formed of a metallic sleeve which has a plurality of outwardly extending radial fins.

* * * * *